US006115542A

United States Patent [19]

Nir

[11] Patent Number: 6,115,542

[45] Date of Patent: Sep. 5, 2000

[54] DEVICE FOR AND METHOD OF STORING AND DISCHARGING A VISCOUS LIQUID

[76] Inventor: Ari Nir, 5800 Arlington Ave., #4B, Riverdale, N.Y. 10471

[21] Appl. No.: 09/455,352

[22] Filed: Dec. 6, 1999

Related U.S. Application Data

[63] Continuation-in-part of application No. 08/922,762, Sep. 3, 1997, Pat. No. 6,002,838.

[51] Int. Cl.[7] ..... F24H 1/18; F28F 13/06; F28B 1/00

[52] U.S. Cl. ..... 392/449; 165/108; 165/110

[58] Field of Search ..... 392/449, 441, 392/450, 451, 452, 454, 458; 126/344; 137/340, 341; 165/108, 110, 132

[56] References Cited

U.S. PATENT DOCUMENTS

| | | | |
|---|---|---|---|
| 2,607,535 | 8/1952 | Moore | 237/8 R |
| 3,874,399 | 4/1975 | Ishihara | 137/13 |
| 4,242,569 | 12/1980 | Kayser | 392/358 |
| 4,844,927 | 7/1989 | Morris, II et al. | 426/307 |
| 6,002,838 | 12/1999 | Nir | 392/449 |

*Primary Examiner*—Teresa Walberg
*Assistant Examiner*—Thor Campbell
*Attorney, Agent, or Firm*—I. Zborovsky

[57] ABSTRACT

In a device for and method of storing and discharging a viscous liquid at least one mixing chamber is formed in a storage chamber and communicates with said storage chamber for introducing the viscous liquid from said storage chamber in the mixing chamber; for withdrawing one portion of the viscous liquid only from the mixing chamber, heating the withdrawn one portion of the viscous liquid and reducing its viscosity and returning a part of the one portion of the withdrawn heated viscous liquid with reduced viscosity into the mixing chamber so as to mix it with the viscous liquid introduced from said storage chamber into the mixing chamber and to reduce viscosity of the viscous liquid in the mixing chamber; a second circuit is used for withdrawing another portion of the viscous liquid only from mixing chamber, heating the withdrawn other portion of the viscous liquid and reducing its viscosity, and returning a part of the withdrawn heated other portion of viscous liquid with reduced viscosity to the mixing chamber so as to mix it with the viscous liquid in the mixing chamber and to reduce viscosity of the viscous liquid in the mixing chamber, another part of the liquid withdrawn and heated by the first circuit and having reduced viscosity is discharged to a consumer, and upon determination of a viscosity of the viscous liquid flowing from the mixing chamber into the first circuit the second circuit is turned on or off.

6 Claims, 1 Drawing Sheet

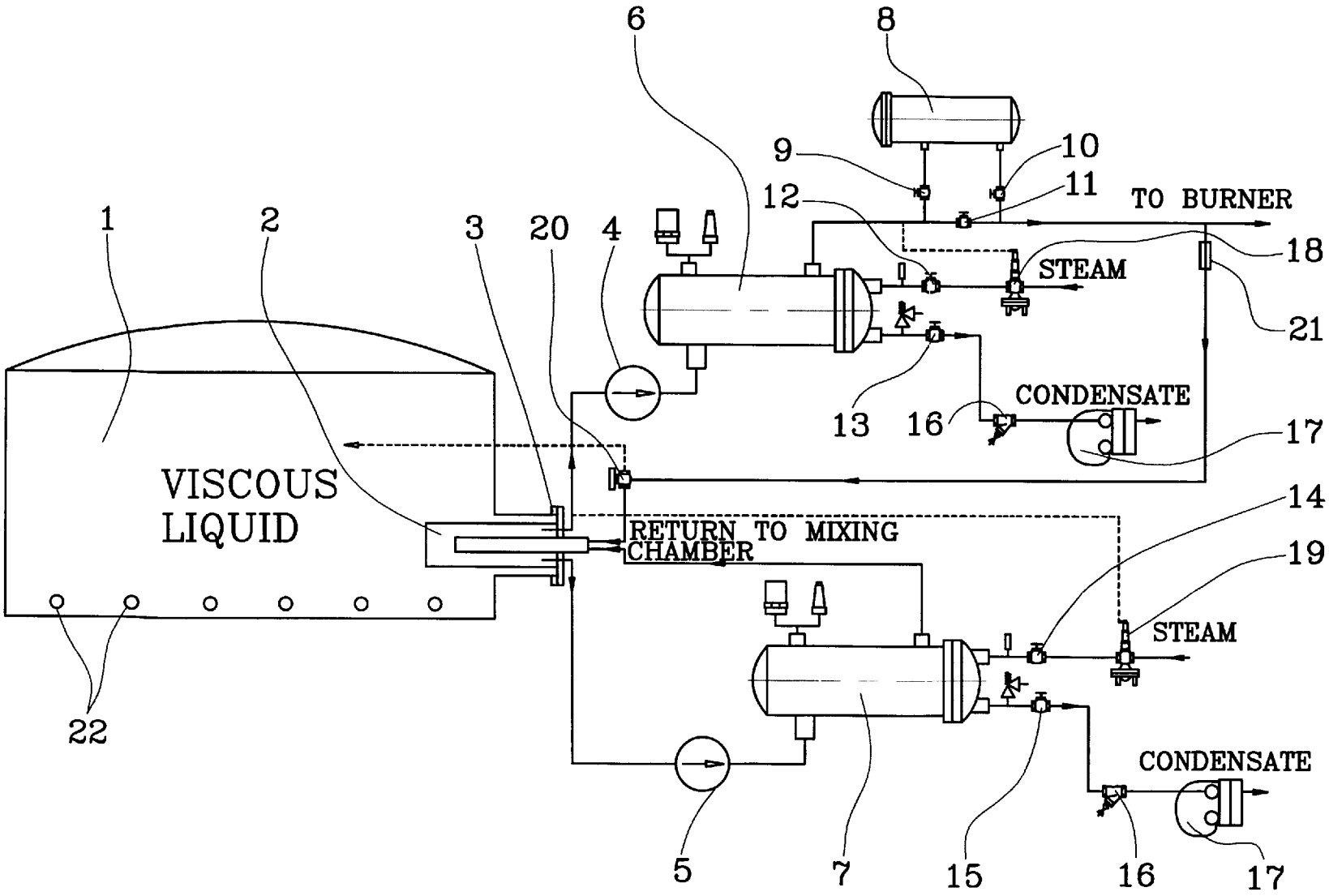
TO BURNER
STEAM
CONDENSATE
STEAM
CONDENSATE
RETURN TO MIXING CHAMBER
VISCOUS LIQUID
1
2
3
4
5
6
7
8
9
10
11
12
13
14
15
16
17
18
19
20
21
22

DEVICE FOR AND METHOD OF STORING AND DISCHARGING A VISCOUS LIQUID

CROSS REFERENCE TO A RELATED APPLICATION

This application is a continuation-in-part of patent application Ser. No. 08/922,762, U.S. Pat. No. 6,002,838, Sep. 3, 1997.

BACKGROUND OF THE INVENTION

Viscous liquids stored in tanks need to be removed to be processed. Due to high viscosity the removal of highly viscous liquid, such as crude oils, fuel oils, lubes oils, asphalt, paint, syrups, present technical problems. Viscosity of liquids substantially depends on their temperature. All viscous liquids will solidify if cooled to corresponding low temperatures called a solid point. To prevent solidification of the viscous liquid in the storage tanks, the liquid in the tank must be heated to retain the viscous liquid in the liquid state (pour point). The pour point is an indication of the lowest temperature at which a viscous liquid can be stored and still be capable of flowing under very low forces. The absolute values of the solid point and the pour point depend on the nature of the viscous liquids and their compositions. The pour point temperature is about 5° F. above the solid point temperature. Usually the storage tanks have heating coils for heating the liquid to keep it movable. At this temperature the viscosity is too high to allow liquid pumping from the storage tank. The further reduction of viscosity tis accomplished by use of an additional heat exchanger.

Heavy fuel oils are byproducts of regular refining operation. The naphtheneoes, aromatics and unsaturated hydrocarbons constitute the bulk of the heavy fuel oil. The amount of wax is relatively small. Depending on the source the pour point of the No. 6 fuel oil may be in the range from 5° F. to 80° F. For waxing No. 6 fuel, the pour point can reach 115° F. For commercial purposes the residual fuel oils are mixed with light fractions of hydrocarbons in order to satisfy the ASTM standard specification for fuel oils.

Viscosity is a single most important property of the fuel oil because of difficulties in the handling and atomizing of the oil. The viscosity of the fuel oil at the pour point is too high to be pumped out of the storage tank. Usually the storage temperature is 20–40° F. higher than the pour point. The high storage temperature of fuel oil results in increased heat losses from the storage tank, and may effect the oil stability.

The U.S. Department of Commerce in its standard CS12-48 recommends maximum practical limit viscosity for pumping 4000 Saybolt Universal Seconds (70–120° F. range). For this purpose the fuel oil is heated by a heat exchanger immersed in the storage tank. Since the heater is installed on the suction line of the fuel pump, they are known as fuel tank suction heaters.

The commercial No. 6 fuel oil is heated in the fuel tank suction heater to the temperature 120–130° F. The further heating is restricted to prevent flash points (about 150° F. for No. 6 fuel oil). The flash point indicates the temperature below which a fuel oil can be handled without danger of fire. In order to prevent the evaporation of the fuel oil during the heating and, pump cavitation, suction heaters are designed for low pressure drop (maximum 2.5 psi). The maximum suction at the pump should be restricted to 18 inch of Hg to allow for pump wear and capacity variations with suction loads. The maximum lift from the bottom of the oil suction pipe to the pump inlet should not exceed 12 feet.

The fuel oil pump and heater system must be adequate to heat the heaviest oil that is to be burned at the maximum rate of consumption in the coldest weather. The pumps should deliver the maximum quantity under pressure specified for the type of burner used. When the steam consumption is reduced, the burner requires less fuel oil. The excess is discharged through the spring-loaded bypass valve to the pump suction or the storage tank. Tank suction heaters raise the fuel oil temperature sufficiently to reduced the viscosity, thus facilitating straining and pumping. The heater located on the discharge side of the pump heats the fuel oil to lower the viscosity of the fuel oil, so that it can be atomized effectively by the burners. Usually burner manufacturers specify the temperature, which is best suited for their burners. For instance, No. 6 fuel oil is heated to 160° F. in horizontal rotary burners, to 220° F. in steam atomizing burners, and to 250° F. in mechanical atomizing burners.

In summary, the modern system of storage and discharge fuel oil requires oil heating in the storage tank by heating coils located on the bottom of the tank, a suction tank heater, installed on the suction side of the pump and an additional heater, installed on the discharge side of the pump. This commonly used method has a number of disadvantages.

First of all, the heating media (steam, hot water, or high temperature liquids) usually have higher pressure than the fuel oil pressure in the tank. In the tank when the suction heater is leaking, the heating media will penetrate the storage tank and contaminate the fuel oil. It is also possible to contaminate the boiler water if the pressure in the storage tank is higher than the pressure in the oil supply line. The repair or removal of the tank suction heater presents technical problems when the storage tank is filled with fuel oil. Secondly, the temperature of the heating media is restricted to prevent the evaporation of the fuel oil in the tank suction heater working and under vacuum. The low temperature of the heated media and the low permitted pressure drop results in a larger size of the tank suction heater. Finally, the maximum lift from the underground tanks is restricted due to pressure drop of the suction heater.

SUMMARY OF THE INVENTION

Accordingly, it is an object of the present invention to provide a device for and a method of storing and discharging viscous liquids, which avoids the disadvantages of the prior art.

In keeping with these objects and with others which will become apparent hereinafter, one feature of present invention resides, briefly stated, in a device for storing and discharging viscous liquids which has means forming a storage chamber for storing a viscous liquid; means forming at least one mixing chamber which is substantially smaller than said storage chamber and communicates with said storage chamber for introducing the viscous liquid from said storage chamber in said mixing chamber; means for separating said mixing chamber from said storage chamber; first means for withdrawing one portion of the viscous liquid only from the mixing chamber, heating the withdrawn one portion of the viscous liquid and reducing its viscosity and returning a part of the one portion of the withdrawn heated viscous liquid with reduce viscosity into the mixing chamber so as to mix it with the viscous liquid introduced from said storage chamber into the mixing chamber and to reduce viscosity of the viscous liquid in the mixing chamber; second means for withdrawing another portion of the viscous liquid only from mixing chamber, heating the withdrawn other portion of the viscous liquid and reducing its viscosity, and returning a part of the withdrawn heated other portion of viscous liquid with reduced viscosity into the mixing chamber so as to mix it with the viscous liquid in the mixing chamber and to reduce viscosity of the viscous liquid in the mixing chamber, said first means being provided with means for discharging another part of the liquid withdrawn and heated by said first means and having reduced viscosity to a consumer; and means for determining a viscosity of the viscous liquid flowing from the mixing chamber into said first means and regulating heating of the other portion of the withdrawn viscous liquid in said second means, so that when the viscosity of the viscous liquid flowing from said mixing chamber into said first means increases above a predetermined level, heating of the other portion of the withdrawn viscous liquid in said second means is increased and additional quantity of the viscous liquid withdrawn from said mixing chamber, heated and returned to the mixing chamber by said second means decreases the viscosity of the viscous liquid in said mixing chamber and also the viscous liquid flowing from said mixing chamber into said first means and to the consumer.

In accordance with another feature of present invention, a method of storing and discharging of viscous liquids is proposed, which includes the steps of forming a storage chamber for storing a viscous liquid; forming at least one mixing chamber which is substantially smaller than said storage chamber and communicates with said storage chamber for introducing the viscous liquid from said storage chamber in said mixing chamber; for separating said mixing chamber from said storage chamber; using first means for withdrawing one portion of the viscous liquid only from the mixing chamber, heating the withdrawn one portion of the viscous liquid and reducing its viscosity and returning a part of the one portion of the withdrawn heated viscous liquid with reduced viscosity into the mixing chamber so as to mix it with the viscous liquid introduced from said storage chamber into the mixing chamber and to reduce viscosity of the viscous liquid in the mixing chamber; using second means for withdrawing another portion of the viscous liquid only from mixing chamber, heating the withdrawn other portion of the viscous liquid and reducing its viscosity, and returning a part of the withdrawn heated other portion of viscous liquid with reduced viscosity into the mixing chamber so as to mix it with the viscous liquid in the mixing chamber and to reduce viscosity of the viscous liquid in the mixing chamber, discharging another part of the liquid withdrawn and heated by said first means and having reduced viscosity to a consumer; determining a viscosity of the viscous liquid flowing from the mixing chamber into said first means and regulating heating of the other portion of the withdrawn viscous liquid in said second means, so that when the viscosity of the viscous liquid flowing from said mixing chamber into said first means increases above a predetermined level, heating of the other portion of the withdrawn viscous liquid in said second means is increased and additional quantity of the viscous liquid withdrawn from said mixing chamber, heated and returned to the mixing chamber by said second means decreases the viscosity of the viscous liquid in said mixing chamber and also of the viscous liquid flowing from said mixing chamber into said first means and to the consumer.

When the device is designed and the method is formed in accordance with the present invention, they eliminate the disadvantages of the prior art.

The novel features, which are considered as characteristic for the present invention, are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a device for storing and discharging of viscous liquids in which a method for storing and discharging of viscous liquids is implemented.

DESCRIPTION OF PREFERRED EMBODIMENTS

A device for storage and discharging of viscous liquids includes a storage chamber, which accommodates a viscous liquid to be discharged. A mixing chamber having substantially small volume is separated from the major part of the storage chamber by a wall and communicates with the storage chamber. Collar and flange means 3 serve for connecting the storage and mixing chambers with two circuits.

The first circuit includes a main pump which withdraws one portion of the viscous liquid form the mixing chamber 3 and pumps it to a preheater which is the main fuel oil preheater 6. The heated fuel oil is supplied to a consumer, for example a burner. A main temperature regulator 18 regulates the temperature of the viscous liquid to be supplied to the burner. While one part of the portion of the viscous liquid withdrawn from the mixing chamber in the first circuit is supplied to the burner, another part of the same portion of the heated viscous liquid is returned through a three-way motorized valve back into the mixing chamber 2 to reduce viscosity of the viscous liquid in the latter. Reference numerals 9, 10, 11, 12 and 13 identify gate valves of the first circuit and the reference numeral 16 and 17 identify a strainer and a stream trap, while reference numeral 20 identifies another three-way motorized valve.

The second circuit which is an auxiliary circuit has an auxiliary pump 5 which withdraws another portion of the viscous liquid from the mixing chamber 2 and supplies it to an auxiliary preheater or an auxiliary fuel oil preheater 7. The other portion of the viscous liquid which is withdrawn from the mixing chamber 2 is heated by the auxiliary fuel oil preheater and returned to the mixing chamber 2 to heat the viscous liquid in it and to reduce its viscosity. Reference numerals 14 and 15 identify gate valves, reference numerals 16 and 17 identify a strainer and a stream trap, and reference numeral 19 identifies auxiliary temperature regulator. Finally, reference numeral 22 identifies steam coils in the storage chamber 21.

During the operation of the device, the main circuit pumps oil from the mixing chamber 2 by the pump 4 with temperature of approximately 120–130° F. to the heat exchanger on the discharge side of the main fuel pump 4, where it is heated up to the temperature needed for the proper operation of the consumer, such as burner. Usually, the flow rate of fuel oil through this circuit is selected to be 15–30% more than the maximum burner capacity. The excess oil returns to the mixing chamber. When the boiler reduces its capacity, more heated oil is returned to the mixing chamber 2.

The purpose of the auxiliary circuit is to pump oil from the mixing chamber 2 by the pump 5 to heat in the auxiliary heater 7 on the discharge side of the auxiliary fuel pump, and to return it to the mixing chamber. The flow rate at the temperature of the No. 6 fuel oil in the auxiliary circuit is calculated to produce a mixture of the desired temperature of 120–130° F.

As a result, three flows are mixed in the mixing chamber, in particular:

A cold fuel oil gravity flow from the storage chamber 1 at storage temperature with a flow rate of a fuel boiler consumption at this moment, an excess fuel oil from the main circuit at a constant temperature of atomizing in the burner but with a variable flow rate depending on the consumption, and fuel oil heated in the auxiliary circuit with a constant flow but a variable temperature.

As long as the temperature of the fuel oil leaving the mixing chamber to the boiler via the main circuit is lower or equal to the requested mixing temperature (120–130° F.), the excess oil returns to the mixing chamber. The auxiliary circuit provides re-circulating oil at maximum temperature. When the temperature in the mixing chamber rises, the heating capacity of the heat exchanger in the auxiliary circuit is reduced. Ultimately, the temperature is reduced to requested mixing temperature and recirculation in the auxiliary circuit stops. At this time mixing of the cold oil gravity flow from the storage chamber and excessive portion of the fuel oil from the main circuit achieve the requested mixing temperature. If the mixing temperature continues to rise, then the thermostat opens the three-way valve 20, and the portion of the hot fuel oil from the main circuit bypasses the mixing chamber 2 and is directed to the storage chamber 1 of the tank.

It is believed to be understood that the auxiliary regulator 19 can measure either a temperature of the viscous liquid supplied from the mixing chamber 2 into the main circuit or just the viscosity of the viscous liquid supplied from the mixing chamber 2 to the main circuit, in order to regulate the operation of the device in dependence on the viscosity which is needed for flowing of the viscous liquid from the mixing chamber 2 into the main circuit and thereafter to the consumer.

It will be understood that each of the elements described above, or two or more together, may also find a useful application in other types of constructions differing from the types described above.

While the invention has been illustrated and described as embodied in device for and method of storing and discharging a viscous liquid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A device for storing and discharging a viscous liquid, comprising means forming a storage chamber for storing a viscous liquid; means forming at least one mixing chamber which is substantially smaller than said storage chamber and communicates with said storage chamber for introducing the viscous liquid from said storage chamber in said mixing chamber; means for separating said mixing chamber from said storage chamber; first means for withdrawing one portion of the viscous liquid only from the mixing chamber, heating the withdrawn one portion of the viscous liquid and reducing its viscosity and returning a part of the one portion of the withdrawn heated viscous liquid with reduced viscosity into the mixing chamber so as to mix it with the viscous liquid introduced from said storage chamber into the mixing chamber and to reduce viscosity of the viscous liquid in the mixing chamber; second means for withdrawing another portion of the viscous liquid only from mixing chamber, heating the withdrawn other portion of the viscous liquid and reducing its viscosity, and returning a part of the withdrawn heated other portion of viscous liquid with reduced viscosity into the mixing chamber so as to mix it with the viscous liquid in the mixing chamber and to reduce viscosity of the viscous liquid in the mixing chamber, said first means being provided means for discharging another part of the liquid withdrawn and heated by said first means and having reduced viscosity to a consumer; and means for determining a viscosity of the viscous liquid flowing from the mixing chamber into said first means and regulating heating of the other portion of the withdrawn viscous liquid in said second means, so that when the viscosity of the viscous liquid flowing from said mixing chamber into said first means increases above a predetermined level, heating of the other portion of the withdrawn viscous liquid in said second means is increased and additional quantity of the viscous liquid withdrawn from said mixing chamber, heated and returned to the mixing chamber by said second means decreases the viscosity of the viscous liquid in said mixing chamber and also of the viscous liquid flowing from said mixing chamber into said first means and to the consumer.

2. A device as defined in claim 1, wherein said first means is formed so that the one portion of the viscous fluid which is withdrawn from the mixing chamber, heated and returned to the mixing chamber in said first means has a constant temperature and a variable flow rate, while the other portion of the viscous fluid which is withdrawn from said mixing chamber, heated and returned to said mixing chamber has a constant flow rate and a variable temperature.

3. A device as defined in claim 1, wherein said means for determining a viscosity is means for determining a temperature of the viscous liquid flowing from said mixing chamber into said first means.

4. A method of storing and discharging a viscous liquid, comprising the steps of forming a storage chamber for storing a viscous liquid; means forming at least one mixing chamber which is substantially smaller than said storage chamber and communicates with said storage chamber for introducing the viscous liquid from said storage chamber in said mixing chamber; separating said mixing chamber from said storage chamber; using first means for withdrawing one portion of the viscous liquid only from the mixing chamber, heating the withdrawn one portion of the viscous liquid and reducing its viscosity and returning a part of the one portion of the withdrawn heated viscous liquid with reduced viscosity into the mixing chamber so as to mix it with the viscous liquid introduced from said storage chamber into the mixing chamber and to reduce viscosity of the viscous liquid in the mixing chamber; using second means for withdrawing another portion of the viscous liquid only from mixing chamber, heating the withdrawn other portion of the viscous liquid and reducing its viscosity, and returning a part of the withdrawn heated other portion of viscous liquid with reduced viscosity with the mixing chamber so as to mix it with the viscous liquid in the mixing chamber and to reduce viscosity of the viscous liquid in the mixing chamber; discharging another part of the liquid withdrawn and heated by said first means and having reduced viscosity to a consumer; determining a viscosity of the viscous liquid flowing from the mixing chamber into said first means and regulating heating of the other portion of the withdrawn viscous liquid in said second means, so that when the viscosity of the viscous liquid flowing from said mixing chamber into said first means increases above a predetermined level, heating of the other portion of the withdrawn viscous liquid in said second means is increased and additional quantity of the viscous liquid withdrawn from said mixing chamber, heated and returned to the mixing chamber by said second means increases the viscosity of the viscous liquid in said mixing chamber and also of the viscous liquid flowing from said mixing chamber into said first means and to the consumer.

5. A method as defined in claim 4; and further comprising the steps of forming said first means so that the one portion of the viscous fluid which is withdrawn from the mixing chamber, heated and returned to the mixing chamber in said first means has a constant temperature and a variable flow rate, forming the second means so that the other portion of the viscous fluid which is withdrawn from said mixing chamber, heated and returned to said mixing chamber has a constant flow rate and a variable temperature.

6. A method as defined in claim 4; and further comprising determining the viscosity by determining a temperature of the viscous liquid withdrawn from the mixing chamber into the first means.

* * * * *